US005365208A

United States Patent [19]

Ito et al.

[11] Patent Number: 5,365,208

[45] Date of Patent: Nov. 15, 1994

[54] MICROWAVE STRIPLINE FILTER FORMED FROM A PAIR OF DIELECTRIC SUBSTRATES

[75] Inventors: Kenji Ito; Hiroyuki Shimizu; Seigo Hino, all of Nagoya, Japan

[73] Assignee: NGK Spark Plug Co., Ltd., Aichi, Japan

[21] Appl. No.: 949,627

[22] PCT Filed: Apr. 8, 1992

[86] PCT No.: PCT/JP92/00440

§ 371 Date: Dec. 7, 1992

§ 102(e) Date: Dec. 7, 1992

[87] PCT Pub. No.: WO92/17913

PCT Pub. Date: Oct. 15, 1992

[30] Foreign Application Priority Data

| | | | |
|---|---|---|---|
| Apr. 8, 1991 | [JP] | Japan | 3-075229 |
| Apr. 8, 1991 | [JP] | Japan | 3-075232 |
| May 15, 1991 | [JP] | Japan | 3-110316 |

[51] Int. Cl.[5] ..... H01P 1/203

[52] U.S. Cl. ..... 333/204; 333/246

[58] Field of Search ..... 333/203, 204, 205, 219, 333/238, 246, 234; 228/121, 248; 29/600; 501/134, 137

[56] References Cited

U.S. PATENT DOCUMENTS

| | | | |
|---|---|---|---|
| 4,266,206 | 5/1981 | Bedard et al. | 333/204 |
| 4,609,892 | 9/1986 | Higgins, Jr. | 333/204 |
| 4,785,271 | 11/1988 | Higgins, Jr. | 333/204 |
| 4,940,955 | 7/1990 | Higgins, Jr. | 333/219 X |

FOREIGN PATENT DOCUMENTS

| | | |
|---|---|---|
| 0077304 | 5/1983 | Japan . |
| 0043902 | 2/1987 | Japan . |
| 0194702 | 8/1987 | Japan . |
| 0041802 | 2/1991 | Japan . |

*Primary Examiner*—Seungsook Ham
*Attorney, Agent, or Firm*—Larson & Taylor

[57] ABSTRACT

A microwave strip line filter has a pair of dielectric substrates being stacked and bonded to each other, which are similar in pattern but different in dimension. The dielectric substrates are bonded to each other with spots of bonding agent applied to resonant electrodes on one of the dielectric substrates, thereby preventing the electric characteristic from being adversely affected by bonding agent when the dielectric substrates are superimposed and bonded to each other. The dielectric substrates are made of ceramic materials having relative dielectric constants in order to easily and exactly obtain various desirable resonant frequency characteristics by using resonant electrodes having the same pattern.

1 Claim, 4 Drawing Sheets (PRIOR ART)

MICROWAVE STRIPLINE FILTER FORMED FROM A PAIR OF DIELECTRIC SUBSTRATES

TECHNICAL FIELD

The present invention relates to a microwave stripline filter that which may be used as a band-pass filter.

BACKGROUND ART

There is known a variety of microwave stripline filters can be used as bandpass filters for a microwave range.

FIG. 1 of the accompanying drawings illustrates an example of such microwave stripline filters of a known type in which it comprises two superimposed dielectric substrates 1*a* and 1*b* made of a $BaO\text{-}TiO_2$ or $BaO\text{-}TiO_2$-rare type dielectric ceramic material having a high dielectric constant and a low loss factor. The dielectric substrates 1*a* and 1*b* are provided with ground conductors 2*a* and 2*b* on the outer surface and peripheral portion thereof, respectively. On the inner surface of one 1*a* of the dielectric substrates 1*a* and 1*b* are disposed a plurality of strip-shaped resonator conductors 3*a* which operate as a filter element. Each resonator conductor has one end connected to the ground conductor 2*a* to form a short-circuit terminal, while the other end of each resonator conductor is not connected to any ground conductor to form an open-circuit terminal. The open-circuit terminals of the strip-shaped resonator conductors 3*a* are alternately arranged to form an interdigitated-type arrangement. A stripline filter of the above described type is disclosed in Japanese Patent Kokai No. 54-87480.

With such an arrangement in which the resonator conducors 3*a* having a desired pattern are formed on the inner surface of one of two dielectric substrates 1*a* and 1*b*, and sandwiched between said inner surface and the inner surface of the other dielectric substrate, a gap may often be formed partially between the resonator conductors 3*a* and the inner surface of the other dielectric substrate 1*b* when the latter is stacked on the former. Therefore, there is disadvantage that electric characteristics between the respective resonator conductors 3*a* are varied so that the response frequency of the filter may deviated.

In order to improve such disadvantage, there has been proposed another microwave stripline filter in which as illustrated in FIG. 2 two dielectric substrates 4*a* and 4*b* are provided with respective resonator conductors 5*a* and 5*b* having a substantially same pattern and same dimensions on the respective inner surfaces. The resonator conductors 5*a* and 5*b* are bonded together as the dielectric substrates 4*a* and 4*b* are stacked to each other (see Japanese Patent Kokai 3-41802).

In the conventional microwave stripline filter in which two dielectric substrates are provided with respective resonator conductors on the respective inner surfaces, and are stacked and bonded to each other, since respective resonator conductors on the respective inner surfaces have same pattern and same dimensions, the stacking of the dielectric substrates should be performed so that the resonator conductors on one dielectric substrate and the resonator conductors on the other dielectric substrate are overlapped without getting out of position. Consequently, the fact is that this assembling process depends upon the manual procedure of person skilled in the art, and thus there are problems in the manufacturing cost and productivity. Further, it is necessary to provide the resonator conductors on the inner surface of each substrate with very restricted tolerance because the resonator conductors should be formed on the inner surface of each dielectric substrate without involving any positional deviation. Even if the resonator conductors are accurately formed on the inner surface of each dielectric substrate with a predetermined position and dimension, and the dielectric substrates are stacked to each other by those skilled in the art, it is substantially difficult to ascertain whether or not the resonator conductors on the both substrates are deviated from each other at stacking them. As a result, the stacked and bonded resonator conductors on the both substrates may be deviated from each other. As shown in FIG. 3, for example, if any deviation occurs in the axial direction of the resonator conductors, there may occur disadvantages that the distance between the adjacent resonator conductors is deviated from a set value and the resonant frequency is varied.

In such stripline filters conventionally proposed, also, when being assembled two dielectric substrates are stacked and bonded to each other by applying adhesive such as cream solder of the like to the whole surface of the resonator conductors on either one of both of the dielectric substrates. As a result, the adhesive 6 can be partly squeezed by and flows out of the resonator conductors. Then, the squeezed bonding agent can adversely affect the electric characteristic of the resonator conductors so that the filter may have deviated resonant frequency, that cannot be corrected in the subsequent stage of fine adjustment of the resonant frequency of the filter, making the yield of manufacture of filters undesireably low.

The use of a relatively large quantity of cream solder and other bonding agents can also deteriorate the Q value of the produced filters because of the low electric conductivity of such agents relative to that of precious material such as silver used for the resonant conductors.

Furthermore, with the conventional stripline filter having two dielectric substrates which are superimposed and bonded with the resonant conductors sandwiched therebetween, it is known that the filter has a resonant frequency characteristic which depends on a relative dielectric constant or a specific inductive capacity of material used as well as the pattern of the resonant conductors. In order to obtain a desired resonant frequency it is of common use that the composition of the substrate material is changed so as to adjust the relative dielectric constant. By using this method it is expected to obtain in design a substrate having a desired relative dielectric constant, but the value of the the relative dielectric constant may be changed after sintering. It is, therefore, the actual circumstances that the adjustment of the composition of the substrate material is repeatedly performed until a desired characteristic is obtained. This leads to a bad productivity.

Furthermore, since the respective dielectric substrates are made of ceramic material having same dielectric constant, the filtering characteristic to be obtained may be substantially determined by the pattern of the resonant conductors which are sandwiched between the dielectric substrates. Therefore, in order to produce a filter having a desired filtering characteristic, it is necessary to design or determine the pattern of resonant conductors whenever the filter is to be manufactured. This also adversely affects the productivity. That is, in the conventional stripline filter of this type, due to the fact that the resonant frequency characteristic to be obtained depends upon mainly the pattern of the resonant conductors and the dielectric constant of the substrate material used, it may be difficult to produce a filter having a relatively exact and desirable characteristic, and thus it is generally required to finely adjust the resonant frequency characteristic after the filter device is assemblied, thereby increasing the manufacturing cost thereof.

It is therefore a first object of the present invention to provide a stripline filter for microwaves capable of overcoming the disadvantages in the conventional filter, having no dispersion in a filtering characteristic and being assembled with a relative large tolerance.

A second object of the present invention is to provide a stripline filter for microwaves wherein it has no dispersion in a filtering characteristic, a good yield can be attained, and any reduction of the Q value can be suppressed.

A third object of the present invention is to provide a stripline filter for microwaves wherein a resonant frequency characteristic can be finely selected and a desired value thereof can be relatively exactly obtained.

DISCLOSURE OF THE INVENTION

In order to attain these objects described above, according to one aspect of the present invention, there is provided a microwave stripline filter having a pair of dielectric substrates each provided with a ground conductor on the outer surface and resonant electrodes on the inner surface, said dielectric substrates being stacked and bonded so that the resonant electrodes are superimposed to each other, characterized in that the resonant electrodes formed on the inner surface of one of the dielectric substrates have a predetermined pattern and dimensions, and the resonant electrodes formed on the inner surface of the other dielectric substrate have a pattern and dimensions smaller than said predetermined pattern and dimensions.

In the first aspect of the present invention, the scaling down of the resonant electrodes on the inner surface of the other dielectric substrate may be arbitrarily set with respect to the predetermined pattern and dimensions on the inner surface of said one dielectric substrate.

In the filter according to the first aspect of the present invention, since the resonant electrodes formed on the inner surface of one of the respective dielectric substrates have the predetermined pattern and dimensions, and the resonant electrodes on the other dielectric substrate have a pattern and dimensions smaller than the predetermined pattern and dimensions, the smaller resonant electrodes are not jutted out beyond the bounds of said the resonant electrodes having the predetermined pattern and dimensions even if the both dielectric substrates are superimposed to each other so that the positioning of the resonant electrodes on the both substrates is made with a little shear. It is, therefore, possible to maintain an electric characteristic to a set level which is determined by the resonant electrodes of predetermined pattern and dimensions.

A microwave stripline filter according to a second aspect of the present invention a pair of dielectric substrates are bonded to each other by applying a bonding agent such as cream solder to the surfaces of the resonant electrodes on either one of the dielectric substrates to form spots of bonding agent and subsequently putting the electrodes together.

In the microwave stripline filter according to the second aspect of the present invention, preferably, the resonant electrodes formed on the inner surface of either one of the dielectric substrates are formed to have a predetermined pattern and a set of predetermined dimensions and the resonant electrodes formed on the inner surface of the other dielectric substrate are formed to have a similar but smaller pattern and another set of dimensions obtained by proportionally reducing the respective dimensions of the resonant electrodes on the one dielectric substrate, and a bonding agent such as cream solder is in a dotted configuration applied to the smaller resonant electrodes.

With the microwave stripline filter according to the second aspect of the present invention, since the bonding agent such as cream solder is applied to the resonant electrodes arranged on the inner surface of either one of of the dielectric substrates to form spots of bonding agent, it can hardly be squeezed by and flow out of the resonant electrodes when the dielectric substrates are put together so that the filter may realize intended electric characteristics that are determined by the resonant electrodes having the predetermined pattern and dimensions. Besides, since the amount of bonding agent consumed for producing a required level of adhesive power for the resonant electrodes is minimized, it is possible to suppress any deterioration of the Q value.

When the resonant electrodes arranged on the inner surface of either one of the pair of dielectric substrates is formed to show a pattern similar to that of the resonant electrodes on the other substrate but a set of dimensions which are smaller than those of the electrodes on the other substrate, and a bonding agent is applied to the smaller resonant electrodes to form spots of bonding agent, there may be obtained not only an advantage that the bonding agent is not squeezed by flowing out of the resonant electrodes but also an additional advantage that the smaller resonant electrodes may not be displaced from the effective area of the larger resonant electrodes even if the two substrates are not exactly aligned with each other for superimposing them so that the intended electric characteristics of the filter that are determined by the resonant electrodes of the predetermined pattern and dimensions can be properly realized.

According to a third aspect of the present invention, there is provided a microwave stripline filter having a pair of dielectric substrates each provided with a ground conductor on the outer surface and resonant electrodes on the inner surface, said dielectric substrates being stacked and bonded so that the resonant electrodes thereon are superimposed to each other, characterized in that the pair of the dielectric substrates are made of ceramic materials having different relative dielectric constants, respectively.

With the microwave stripline filter according to the third aspect, by the provision of the two dielectric substrates made of ceramic materials having different relative dielectric constants, there is obtained a relative dielectric constant between the different relative dielectric constants. By suitablly selecting ceramic material for each substrate, therefore, it is possible to finely adjust the resonant frequency characteristic to be obtained even if the resonant electrodes having same pattern are used. As a result, it is possible to substantially avoid or very simplify the adjusting of the response frequency after producing of the filter device.

PREFERRED FORMS BY WHICH THE INVENTION IS TO BE EXECUTED

The present invention will now be in more detail described by way of embodiments as illustrated in FIGS. 4 through 8 of the accompaning drawings.

Figure 1:
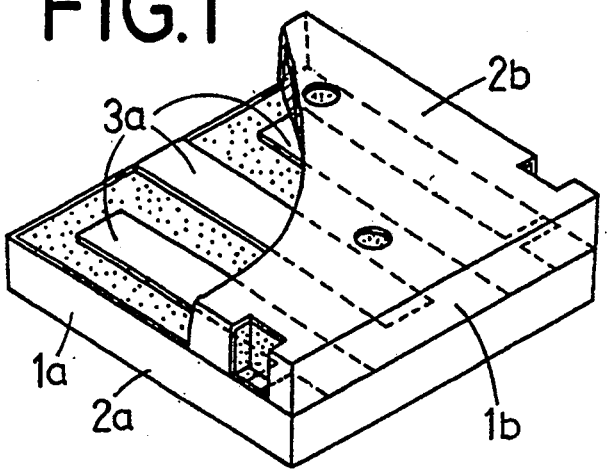
FIG. 1 is a partially cut-out perspective view showing an example of conventional microwave stripline filters.
Figure 2:
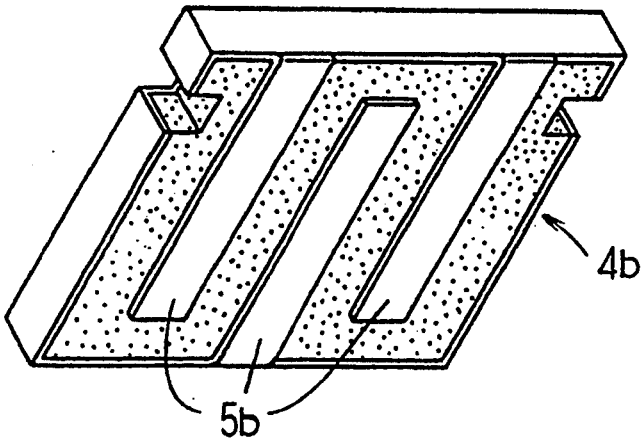
FIG. 2 (PRIOR ART)
FIG. 2 is an exploded perspective view showing another conventional stripline filter.
Figure 2:
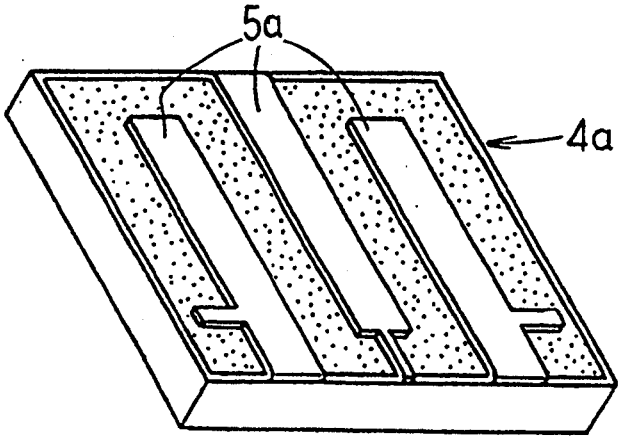
FIG. 2 (PRIOR ART)
Figure 3:
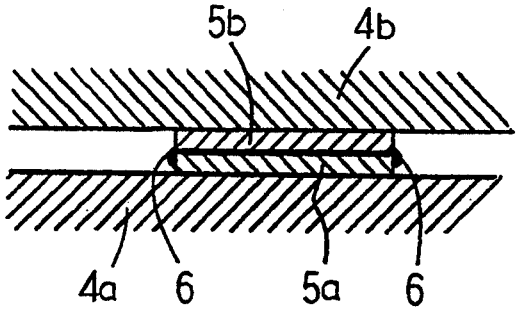
FIG.3 (PRIOR ART)
FIG. 3 is an enlarged partial sectional view of the microwave stripline filter of FIG. 2 showing how the resonant conductors are bonded together.
Figure 4:
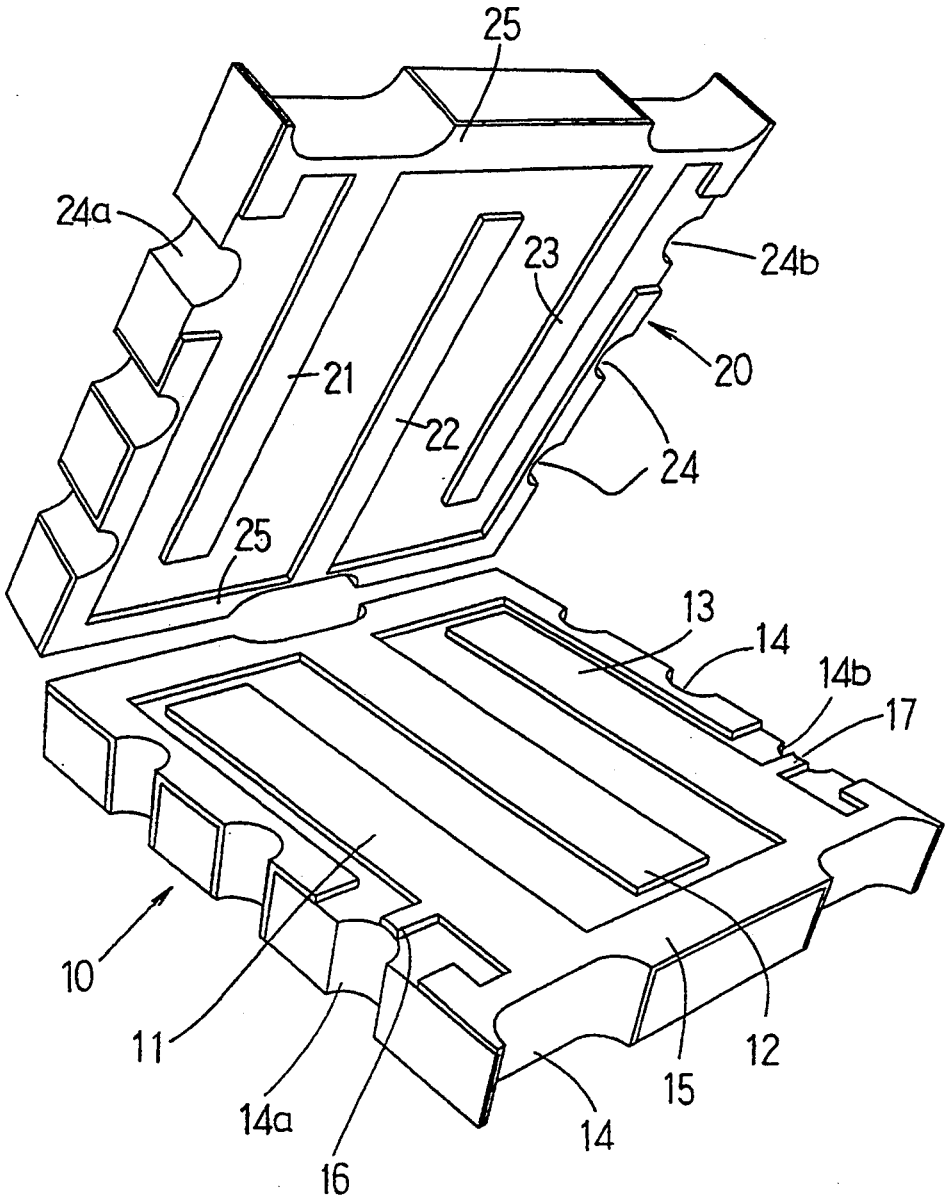
FIG. 4 is an exploded perspective view showing a microwave stripline filter according to one embodiment of the present invention.
Figure 5:
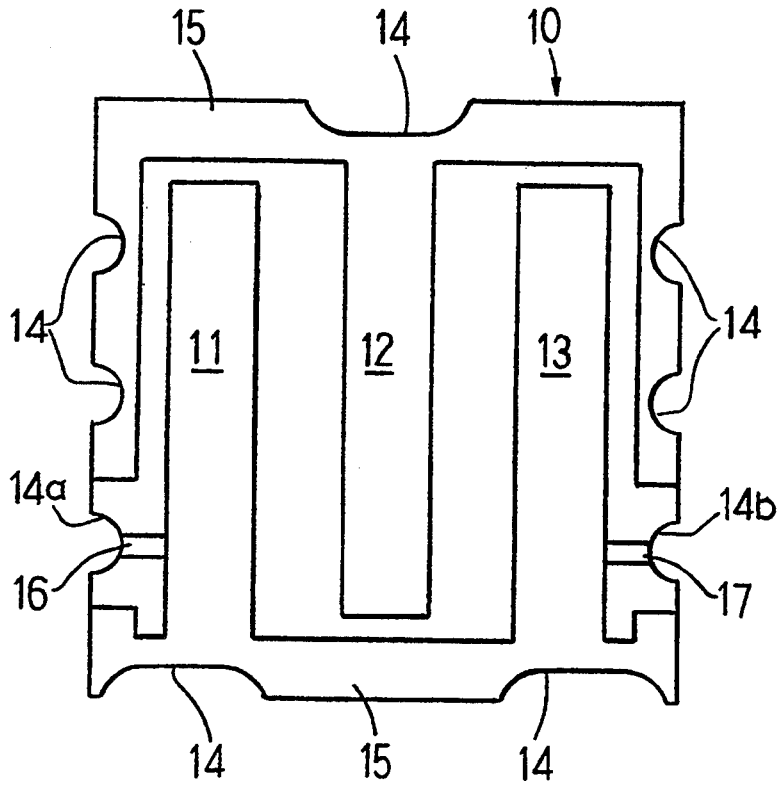
FIG. 5 is a plan view of one of dielectric substrates which construct the microwave stripline filter of FIG. 4.
Figure 6:
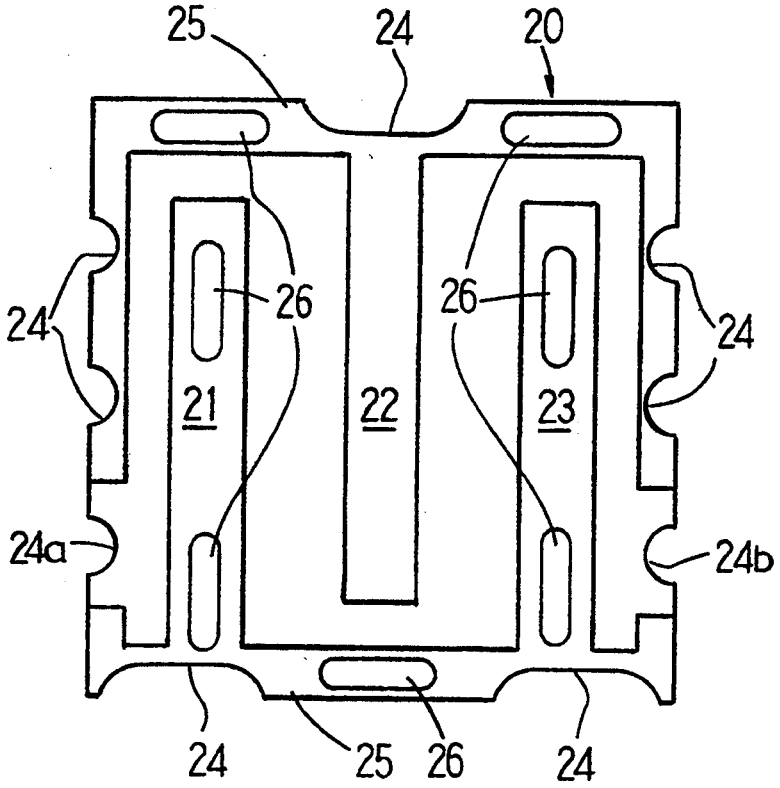
FIG. 6 is a plan view of the other dielectric substrate which constructs the microwave strip line filter of FIG. 4.

FIGS. 4 through 6 illustrate a stripline filter for microwaves according to an embodiment of the present invention. The illustrated filter comprises a pair of dielectric substrates 10 and 20 made of a $BaO\text{-}TiO_2$ or $BaO\text{-}TiO_2$-rare type dielectric ceramic material having a high dielectric constant and a low loss factor. A ground conductor (not shown) is formed on the outer surface of one of the substrates 10 which is exposed to the atmosphere when the substrates are assembled, while a plurality of (three in the illustrated arrangement) strip-shaped resonant conductors 11, 12 and 13 that operate as a filter element are formed on the inner surface of one substrate 10 which is closed or covered when the substrates are assembled. As will be seen, a plurality of notches 14 are formed along the peripheral portion of the substrate 10, and each of the notches 14 is provided with a short-circuiting conductor 15 extending from the corresponding edge of the inner surface to the corresponding edge of the outer surface except the notches 14*a* and 14*b*. An end of each of the strip-shaped resonant conductors 11, 12 and 13 is connected to the ground conductor on the outer surface by way of a corresponding one of the short-circuiting conductors 15 to form a short-circuiting terminal, while the other ends of the strip-shaped resonant conductors 11, 12 and 13 are spaced apart from the corresponding respective short-circuiting conductors 15 to form open-circuit terminals. These open-circuit terminals of the strip-shaped resonant conductors 11, 12 and 13 are arranged in an alternating manner to form an interdigitated type arrangement. The two outer ones 11 and 13 of the three strip-shaped resonant conductors 11, 12 and 13 are provided with respective connecting terminals 16 and 17 which are laterally extended to reach the respective notches 14*a* and 14*b* as shown and connected to respective input terminals (not shown).

The other dielectric substrate 20 is also provided with a ground conductor short-circuiting conductors and strip-shaped resonant conductors. More specifically, a ground conductor (not shown) is formed on the outer surface of the other dielectric substrate 20, while three strip-shaped resonant conductors 21, 22 and 23 are arranged to corresponding portions on the inner surface of the dielectric substrate 20. These strip-shaped resonant conductors 21, 22 and 23 are arranged to show mirror images of the corresponding respective strip-shaped resonant conductors 11, 12 and 13 but have widths and lengths slightly smaller than those of the strip-shaped resonant conductors 11, 12 and 13. Further, the dielectric substrate 20 is provided with a plurality of notches 24 which are arranged along the peripheral portion of the substrate 20 at positions where correspond to those of the respective notches 14 of the dielectric substrate 10. As in the case of the notches 14 of the dielectric substrate 10, each of the notches 24 is provided with a short-circuiting conductor 25 extending from the corresponding edge of the inner surface to the corresponding edge of the outer surface expect the notches 24*a* and 24*b*. In this connection, the width of each of the short-circuiting conductors 25 is determined so that it is slightly smaller than that of the corresponding short-circuiting conductor 15. An end of each of the strip-shaped resonant conductors 21, 22 and 23 is connected to the ground conductor on the outer surface by way of a corresponding one of the short-circuiting conductors 25 to form a short-circuiting terminal, while the other ends of the strip-shaped resonant conductors 21, 22 and 23 are spaced apart from the corresponding respective short-circuiting conductors 25 to form open-circuit terminals. These open-circuiting terminals of the strip-shaped resonant conductors 21, 22 and 23 are arranged in an alternating manner to form an interdigitated type arrangement.

The two dielectric substrates 10 and 20 provided with the respective resonant conductors, ground conductors and short-circuiting conductors are then put together with a bonding agent such as cream solder applied to the smaller resonant conductors and short-circuiting conductors. Since the strip-shaped resonant conductors 21, 22 and 23 arranged on the inner surface of the dielectric substrate 20 are smaller than the corresponding respective resonant conductors 11, 12 and 13 having predetermined dimensions, the strip-shaped resonant conductors 21, 22 and 23 can not be displaced out of the effective area of the respective resonant conductors 11, 12 and 13 of the dielectric substrate 10.

As a modification of the illustrated embodiment the two dielectric substrates 10 and 20 may be bonded to each other by applying a bonding agent such as cream solder to the smaller resonant conductors and short-circuiting conductors provided on the dielectric substrate 10 so as to form spots of the bonding agent as shown by 26 in FIG. 6. Since the strip-shaped resonant conductors 21, 22 and 23 arranged on the inner surface of the dielectric substrate 20 are smaller than the corresponding respective resonant conductors 11, 12 and 13 having predetermined dimensions and the bonding agent is spottily applied, the bonding agent 26 can hardly be squeezed out of the effective area of the respective resonant conductors 11, 12 and 13 of the dielectric substrate 10 nor can the strip-shaped resonant conductors 21, 22 and 23 can be displaced out of the effective area of the respective resonant conductors 11, 12 and 13 of the dielectric substrate 10 when the both dielectric substrates 10 and 20 are superimposed to each other. Consequently, the produced filter is not adversely affected by the bonding agent 26 and shows intended and desired electric characteristics even if the resonant conductors of each dielectric substrate are positioned with a slight displacement from their proper positions at the time of forming them on the inner surface of each dielectric substrate.

With the illustrated embodiment, the resonant conductors on the dielectric substrate 10 have a desired pattern of predetermined dimensions while the resonant conductors on the dielectric substrate 20 have dimensions slightly smaller than the predetermined ones. However, they may alternatively prepared to conform to the predetermined dimensions.

Also, while the resonant conductors are arranged to form an interdigitated type filter, they may be alternatively be so arranged to form a filter of any other type such as a comb-type.

Further, in case the bonding agent 26 such as cream solder are spottily applied to the resonant conductors in order to bond the both dielectric substrates to each other, it is also possible to form the respective resonant conductors on the both dielectric substrates with the pattern having predetermined dimensions.

Figure 7:
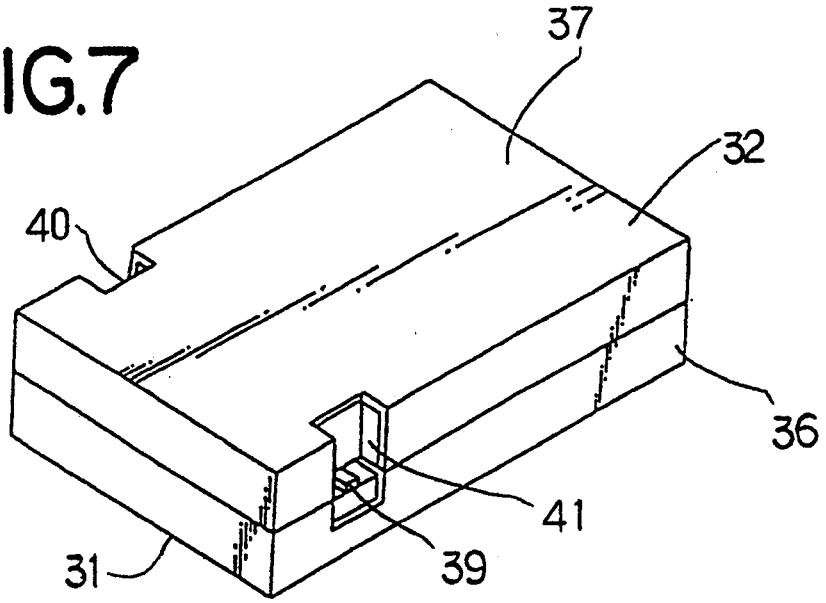
FIG. 7 is a perspective view showing a microwave stripline filter according to another embodiment of the present invention.
Figure 8:
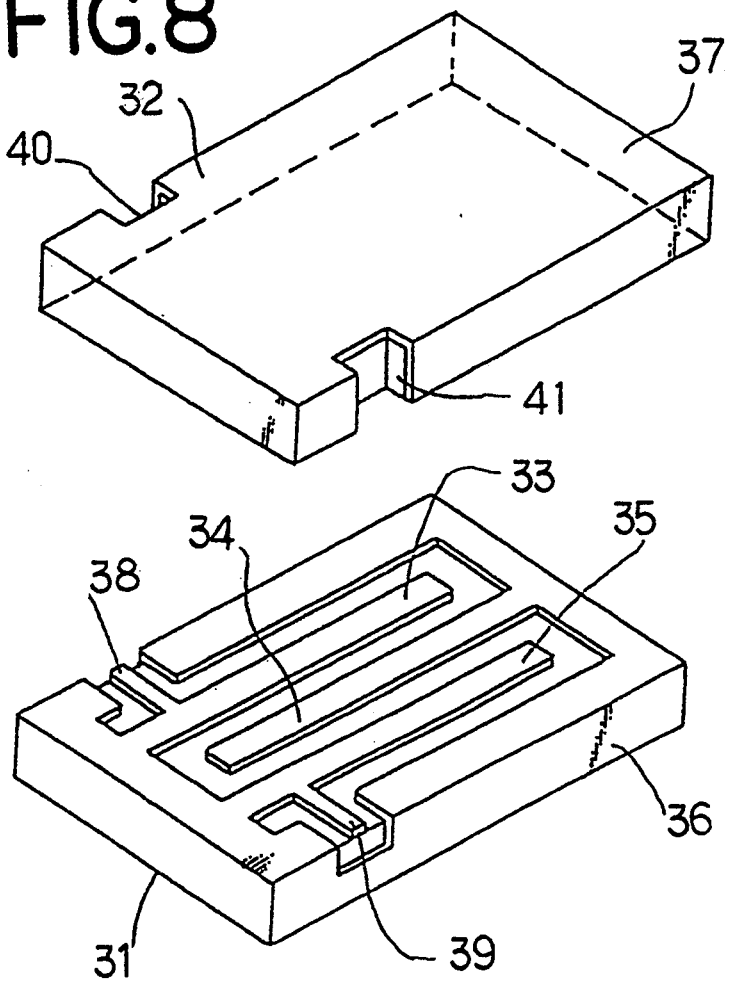
FIG. 8 is an exploded perspective view showing a pair of dielectric substrates which form the microwave stripline filter of FIG. 7.

FIGS. 7 and 8 illustrate another embodiment of the present invention. The illustrated strip line filter comprises two dielectric substrates 31 and 32. On the upper surface of one 31 of the dielectric substrates 31 and 32 there are provided a plurality of (three in the illustrated arrangement) strip-shaped resonator conductors 33, 34 and 35 on which the other dielectric substrate is superimposed and fixed. Each of the the dielectric substrates 31 and 32 is provided with ground conductors 36 and 37 on the outer and peripheral surfaces, respectively. These ground conductors may be formed by using a suitable method such as a plating or a deposition.

Each of the resonator conductors 33, 34 and 35 has one end connected to the ground conductor 36 so as to form a short-circuiting terminal, and the other end spaced from the ground conductor 36 to form an open-circuit terminal. The other ends of the resonator conductors 33, 34 and 35 are alternately disposed to form an interdigitated arrangement. Further, as shown in FIG. 8 the two outer resonator conductors 33 and 35 of the three resonator conductors 33, 34 and 35 are respectively provided with lateral extensions 38 and 39 which form connector terminals. The forward ends of these connector terminals 38 and 39 are positioned to be partially exposed at notches 40 and 41 provided on the peripheral portion of the other dielectric substrate 32 when the both dielectric substrates 31 and 32 are superimposed as shown in FIG. 7. Also, these connector terminals 38 and 39 are connected with an input and output terminals not shown. A suitable film forming method such as a plating or a deposition may be utilized for forming the resonator conductors 33, 34 and 35 on the dielectric substrate 31 and the connector terminals 38 and 39 as in the case of forming the ground conductors 36 and 37.

In this embodiment, the dielectric substrates 31 and 32 are made of ceramic materials which have different relative dielectric constants. Now, for example, for the material of the first dielectric substrate 31 there may be used a dielectric ceramic material having a composition represented by x $BaO.y\ TiO_2\ .z\ Nd_2O_3+w\ Y_2O_3$ [x=17.7 mole %, y=69.8 mole %, z=12.5 mole % and w=7.5 weight %], and a relative dielectric constant or a specific inductive capacity $\epsilon 1$. For the material of the other dielectric substrate 32 there may be used dielectric ceramic material having a composition represented by x $BaO.y\ TiO_2.z\ Nd_2O_3+w\ Y_2O_3+v\ Al_2O_3$ [x=17.7 mole %, y=69.8 mole %, z=12.5 mole %, w=7.5 weight % and v=1 weight %] and a relative dielectric constant or a specific inductive capacity $\epsilon 2$. These materials are worked into the structures shown in FIG. 7 which in turn are assembled to each other to form a stripline filter. It is found that the thus formed stripline filter has a filtering characteristic with a relative dielectric constant of a value between $\epsilon 1$ and $\epsilon 2$.

By preparation of a number of dielectric substrates having different known relative dielectric constants, therefore, it is possible to provide a filter having a desired resonant frequency characteristic without substantial dispersion by suitably combining the prepared dielectric substrates even if the same resonant conductor pattern is used.

With the embodiment illustrated in FIGS. 7 and 8, there is described with respect to the filter arrangement in which the resonant conductors are provided only on the one dielectric substrate 31. It should, however, be appreciated that the present invention may be applied to a filter arrangement in which the both dielectric substrates are provided with resonant conductors having a corresponding pattern or any other filter arrangement in which resonant conductors are arranged in any suitable shape such as comb type other than the interdigitated shape.

INDUSTRIAL APPLICABILITY

As described above, according to the present invention since the resonant electrodes on one of the paired dielectric substrates are formed to have a predetermined pattern and the resonant electrodes on the other dielectric substrate are formed to have a pattern similar to said predetermined pattern but smaller dimensions, the smaller resonant electrodes may not be displaced from the area of the resonant electrodes of the predetermined pattern having desired dimensions even if two dielectric substrates are not exactly aligned with each other at assembling of them, and thus the dielectric substrates can be superimposed and assemblied without adversely affecting the intended and desired electric characteristics which depend upon the resonant electrodes having the predetermined pattern and dimensions. As a result, the positioning at bonding of the paired dielectric substrates can be carried out with a sufficient tolerance so that the assembling can be easily performed without resorting to the skilled persons. Also, since the electric characteristics are not substantially varied by any dispersion in the positioning of the resonant electrodes when being assembled, it is possible to provide stripline filters having desired electric characteristics with a high yield.

According to the present invention, also, since a bonding agent is applied to the resonant electrodes arranged on one of the paired dielectric substrates to form spots of the bonding agent before the dielectric substrates are put together, the bonding agent can hardly be squeezed out of the effective area of the resonant electrodes and the filter can be assembled without affecting the intended and desired electric characteristics of the resonant electrodes. Moreover, since the amount of the bonding agent to be used is held minimal, any deterioration of the Q value can be effectively prevented and thus strip line filters having stable characteristics can be produced at a high yield.

Furthermore, according to the present invention, since the paired dielectric substrates are made of ceramic materials having different relative dielectric constants, a relative dielectric constant between those dielectric constants can be obtained on the assembled substrates. By suitably selecting ceramic materials having different known relative dielectric constants for the both dielectric substrates, it is possible to exactly set the resonant frequency characteristic of the filter to a desired value even if the resonant electrodes are formed to have the same pattern. As a result, there can substantially be avoided any adjusting of the the response frequency of the filter after producing thereof, which has been carried out in the prior art. The productivity can be increased and the producing cost can be reduced.

We claim:

1. A microwave strip line filter having a pair of dielectric substrates each having an outer surface and an inner surface and each being provided with a ground conductor on the outer surface, at least one of the dielectric substrates being provided with resonant electrodes on the inner surface thereof, said dielectric substrates being stacked and bonded so that the resonant electrodes are sandwiched therebetween the dielectric substrates being made of ceramic materials having different relative dielectric constants, respectively, one of said pair of dielectric substrates being constructed of a dielectric ceramic material having a composition represented by, x BaO.y $TiO_2$.z.$Nd_2O_3$+w $Y_2O_3$, wherein X=17.7 mole %, y=69.8 mole %, z=12.5 mole % and w=7.5 weight %, and the other dielectric substrate being constructed of a dielectric ceramic material having a composition represented by x BaO.y $TiO_2$.z $Nd_2O_3$+w $Y_2O_3$+v $Al_2O_3$, wherein x=17.7 mole %, y=69.8 mole %, z=12.5 mole %, w=7.5 weight % and v=1 weight %.

* * * * *